US007642031B2

(12) United States Patent
Daimon et al.

(10) Patent No.: US 7,642,031 B2
(45) Date of Patent: Jan. 5, 2010

(54) ELECTROPHOTOGRAPHIC TONER AND ELECTROPHOTOGRAPHIC DEVELOPER AND IMAGE FORMING METHOD

(75) Inventors: Katsumi Daimon, Minamiashigara (JP); Yosuke Tsurmi, Minamiashigara (JP); Yusuke Ikeda, Minamiashigara (JP); Hiroyuki Tanaka, Minamiashigara (JP); Satoshi Yoshida, Minamiashigara (JP); Noriyuki Mizutani, Minamiashigara (JP); Shinpei Takagi, Minamiashigara (JP); Hideo Maehata, Minamiashigara (JP); Soichiro Kitagawa, Minamiashigara (JP); Masaru Takahashi, Minamiashigara (JP); Susumu Yoshino, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 542 days.

(21) Appl. No.: 11/491,146

(22) Filed: Jul. 24, 2006

(65) Prior Publication Data

US 2007/0166636 A1 Jul. 19, 2007

(30) Foreign Application Priority Data

Jan. 19, 2006 (JP) ..... 2006-010698

(51) Int. Cl.
*G03G 9/00* (2006.01)

(52) U.S. Cl. ..... 430/109.3; 430/109.4

(58) Field of Classification Search ..... 430/109.3, 430/109.4

See application file for complete search history.

(56) References Cited

U.S. PATENT DOCUMENTS

| | | | |
|---|---|---|---|
| 3,666,363 | A | 5/1972 | Tanaka et al. |
| 3,853,778 | A | 12/1974 | Buckley et al. |
| 4,264,697 | A | 4/1981 | Perez et al. |
| 6,203,956 | B1 | 3/2001 | Urano et al. |
| 2008/0044753 | A1 | 2/2008 | Hirota |

FOREIGN PATENT DOCUMENTS

| | | |
|---|---|---|
| JP | A 42-23910 | 11/1967 |
| JP | A 56-11461 | 2/1981 |
| JP | A 56-13943 | 4/1981 |
| JP | A 62-039879 | 2/1987 |
| JP | A 62-39428 | 8/1987 |
| JP | A 63-25335 | 5/1988 |
| JP | A 6-194874 | 7/1994 |
| JP | A 2000-352839 | 12/2000 |
| WO | WO 2005/111730 A1 | 11/2005 |

OTHER PUBLICATIONS

Fedors, Robert F. "A Method for Estimating Both the Solubility Parameters and Molar Volumes of Liquids." *Polymer Engineering and Science*, vol. 14, No. 2, Feb. 1974.

*Primary Examiner*—Mark A Chapman
(74) *Attorney, Agent, or Firm*—Oliff & Berridge, PLC

(57) ABSTRACT

An electrophotographic toner that includes a colorant, a release agent, a non-crystalline resin and a crystalline resin, wherein the crystalline resin is a polyalkyl acrylate or polyalkyl methacrylate having an alkyl group of approximately 18 or more carbon atoms, and is produced by copolymerization with approximately 10 mol % or more, but no more than approximately 50 mol %, of a vinyl monomer having a carboxyl group.

18 Claims, 1 Drawing Sheet

ELECTROPHOTOGRAPHIC TONER AND ELECTROPHOTOGRAPHIC DEVELOPER AND IMAGE FORMING METHOD

BACKGROUND

1. Technical Field

The present invention relates to an electrophotographic toner and an electrophotographic developer that can be used in an electrophotographic device that uses an electrophotographic process, such as a copying machine, printer, or facsimile, and also relates to an image forming method.

2. Related Art

Generally, a fixed image is formed via multiple steps, including electrically forming a latent image, using any of a variety of techniques, on the surface of a photoreceptor (latent image holding member) that uses a photoconductive material, developing the thus formed latent image using an electrophotographic toner (hereafter also abbreviated as simply "toner"), thereby forming a toner image, subsequently transferring this toner image on the surface of the photoreceptor, either via an intermediate transfer material or directly, to the surface of a recording target material such as a sheet of paper, and fixing the transferred image by heating, pressure application, heated pressure application, or a solvent vapor method. Any residual toner on the photoreceptor surface is then cleaned as necessary, using any of a variety of methods, and the photoreceptor is then supplied for reuse within the above multiple of steps.

A typical technique for fixing the toner image that has been transferred to the surface of the recording target material is the heat roller fixing method, wherein the transfer target to which the toner image has been transferred is passed between a pair of either heated rollers or pressure rollers, thereby fixing the image. Furthermore, another similar fixing method, in which either one, or both of the rollers are replaced with belts, is also known. Compared with other fixing methods, these techniques yield a robust fixed image at greater speed, meaning they offer a higher level of energy efficiency, and they also generate minimal environmental impact resulting from volatilization of solvents or the like.

On the other hand, techniques that enable fixing to be conducted at lower energy levels are desirable in terms of reducing the energy consumption of printers. Accordingly, there is strong demand for electrophotographic toners capable of low-temperature fixing.

Typical techniques for lowering the toner fixing temperature involve lowering the glass transition point of the toner resin (the binder resin). However, if the glass transition point is lowered too far, then aggregation of the toner powder (blocking) becomes increasingly likely, and the storage properties of the toner at the surface of the fixed image deteriorate, meaning from a practical viewpoint, the lower limit for the glass transition point is 50° C. This glass transition point has been used as a specific design feature within many of the currently available toner resins, meaning producing a toner with better low-temperature fixability than conventional toners simply by lowering the glass transition point is no longer possible. Furthermore, the fixing temperature can also be lowered by using a plasticizer, but this generates problems in that blocking occurs during storage of the toner, or even within the developing unit.

The present invention provides an electrophotographic toner, an electrophotographic developer and a film forming method that are capable of realizing low-temperature fixing, are resistant to blocking, and are unlikely to suffer filming on the photoreceptor.

SUMMARY

According to an aspect of the present invention, there is provided an electrophotographic toner that includes a colorant, a release agent, a non-crystalline resin and a crystalline resin, wherein the crystalline resin is a polyalkyl acrylate or polyalkyl methacrylate having an alkyl group of 18 or more carbon atoms, and is produced by copolymerization with at least 10 mol % but no more than 50 mol % of a vinyl monomer having a carboxyl group.

BRIEF DESCRIPTION OF THE DRAWINGS

Embodiment(s) of the present invention will be described in detail based on the following figure, wherein.

DETAILED DESCRIPTION

Figure 1:
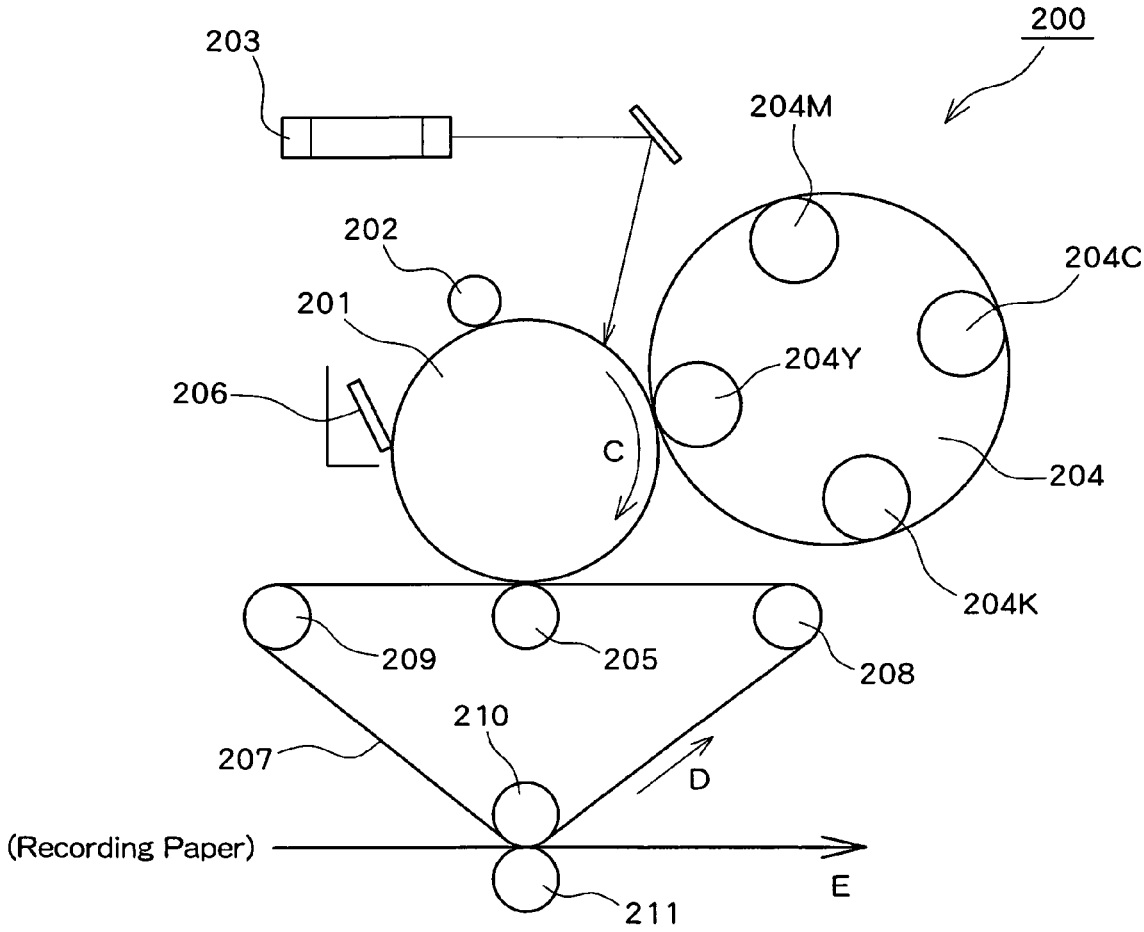
FIG. 1 is a schematic illustration showing a sample configuration of an image formation apparatus that uses an image forming method of the present invention.

As follows is a more detailed description of an electrophotographic toner, an electrophotographic developer, and an image forming method of exemplary embodiments of the present invention.

A toner of an exemplary embodiment of the present invention includes a non-crystalline resin, a crystalline resin, a colorant and a release agent as the principal components, and the crystalline resin is a polyalkyl acrylate or polyalkyl methacrylate having a long-chain alkyl group in the ester portion, and is produced by copolymerization with at least 10 mol % but no more than 50 mol % of a vinyl monomer having a carboxyl group.

<Non-Crystalline Resin>

The non-crystalline resin may use any of those resins conventionally used as toner components. Suitable examples include polystyrene, styrene-butadiene polymers, styrene-acrylic polymers, and polyesters, although this is not a restrictive list. These non-crystalline resins may also be subjected to modification with urethane, urea or epoxy groups or the like.

—Styrene-Based Resins—

Examples of suitable styrene-based resin include the aforementioned polystyrene, styrene-butadiene polymers and styrene-acrylic polymers. These polymers can be produced using the monomers listed below.

Examples of styrene-based monomers include styrene, α-methylstyrene, vinylnaphthalene, alkyl-substituted styrenes having an alkyl chain such as 2-methylstyrene, 3-methylstyrene, 4-methylstyrene, 2-ethylstyrene, 3-ethylstyrene and 4-ethylstyrene, halogen-substituted styrenes such as 2-chlorostyrene, 3-chlorostyrene and 4-chlorostyrene, and fluorine-substituted styrenes such as 4-fluorostyrene and 2,5-difluorostyrene. Styrene is preferred as the styrene-based monomer.

Examples of (meth)acrylate ester monomers include n-methyl(meth)acrylate, n-ethyl (meth)acrylate, n-propyl (meth) acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth)acrylonitrile and (meth) acrylamide. n-butyl acrylate is preferred as the (meth)acrylate ester monomer.

Carboxyl groups can be incorporated into the above styrene-based resins, (meth)acrylate resins, or styrene-(meth) acrylate copolymer resins by conducting copolymerization with a polymerizable monomer having a carboxyl group.

Specific examples of suitable polymerizable monomers having a carboxyl group include acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid and methoxycinnamic acid, and from the viewpoint of the ease with which the polymer-forming reaction can be conducted, acrylic acid, methacrylic acid, maleic acid, cinnamic acid and fumaric acid and the like are preferred, and acrylic acid is particularly desirable.

The binder resin used for the toner particles in a toner set of an exemplary embodiment of the present invention may also employ a chain transfer agent during polymerization. There are no particular restrictions on the chain transfer agent, although the use of a compound containing a thiol component is desirable. Specifically, alkylmercaptans such as hexylmercaptan, heptylmercaptan, octylmercaptan, nonylmercaptan, decylmercaptan and dodecylmercaptan are preferred, and compounds with a narrow molecular weight distribution provide more favorable storage properties for the toner at high temperatures, and are consequently preferred.

Of those binder resins that can be used for the toner particles in a toner set of an exemplary embodiment of the present invention, resins that can be produced by the radical polymerization of a polymerizable monomer may also be produced by polymerization using a radical polymerization initiator.

There are no particular restrictions on the radical polymerization initiator used in this situation. Specific examples of suitable initiators include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl triphenylperacetate hydroperoxide, tert-butyl performate, tert-butyl peracetate, tert-butyl perbenzoate, tert-butyl phenylperacetate, tert-butyl methoxyperaceate and tert-butyl N-(3-toluyl)percarbamate; azo compounds such as 2,2'-azobispropane, 2,2'-dichloro-2,2'-azobispropane, 1,1'-azo(methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-boromophenylazo)-2-allylmalononitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate) and poly(tetraethylene glycol-2,2'-azobisisobutyrate); as well as 1,4-bis(pentaethylene)-2-tetrazene and 1,4-dimethoxycarbonyl-1,4-diphenyl-2-tetrazene.

—Non-Crystalline Polyester Resins—

Non-crystalline polyester resins are obtained mainly through condensation polymerization of a polyvalent carboxylic acid and a polyhydric alcohol. The use of a non-crystalline polyester resin offers the advantage that a resin particle dispersion can be prepared comparatively easily by adjusting the acid value of the resin and using an ionic surfactant to effect an emulsification-dispersion.

Examples of suitable polyvalent carboxylic acids include aromatic carboxylic acids such as terephthalic acid, isophthalic acid, phthalic anhydride, trimellitic anhydride, pyromellitic acid and naphthalenedicarboxylic acid, aliphatic carboxylic acids such as maleic anhydride, fumaric acid, succinic acid, alkenyl succinic anhydride and adipic acid, and alicyclic carboxylic acids such as cyclohexanedicarboxylic acid. These polyvalent carboxylic acids may be used either alone, or in combinations of two or more different compounds. Of these polyvalent carboxylic acids, the use of aromatic carboxylic acids is preferred, and in order to generate cross-linked structures or branched structures to ensure favorable fixability, a trivalent or higher carboxylic acid (such as trimellitic acid or the anhydride thereof) may be used in combination with a dicarboxylic acid.

Examples of suitable polyhydric alcohols include aliphatic diols such as ethylene glycol, diethylene glycol, triethylene glycol, propylene glycol, butanediol, hexane diol, neopentyl glycol and glycerol, alicyclic diols such as cyclohexanediol, cyclohexanedimethanol and hydrogenated bisphenol A, and aromatic diols such as ethylene oxide adducts of bisphenol A and propylene oxide adducts of bisphenol A. These polyhydric alcohols may be used either alone, or in combinations of two or more different compounds. Of these, polyhydric alcohols, aromatic diols and alicyclic diols are preferred, and of these, aromatic diols are particularly desirable. Furthermore, in order to generate cross-linked structures or branched structures to ensure favorable fixability, a trihydric or higher polyhydric alcohol (such as glycerol, trimethylolpropane, or pentaerythritol) may be used in combination with a diol.

A monocarboxylic acid and/or a monoalcohol may also be added to the polyester resin obtained by condensation polymerization of the polyvalent carboxylic acid and polyhydric alcohol, thereby esterifying the hydroxyl groups and/or carboxyl groups at the polymer terminals, and adjusting the acid value of the polyester resin. Examples of suitable monocarboxylic acids include acetic acid, acetic anhydride, benzoic acid, trichloroacetic acid, trifluoroacetic acid and propionic anhydride, whereas examples of suitable monoalcohols include methanol, ethanol, propanol, octanol, 2-ethylhexanol, trifluoroethanol, trichloroethanol, hexafluoroisopropanol and phenol.

The non-crystalline resin polyester resin can be produced by a condensation reaction of the above polyhydric alcohol and polyvalent carboxylic acid using conventional methods. In one example of a production method, the polyhydric alcohol, the polyvalent carboxylic acid, and where necessary a catalyst, are blended together in a reaction vessel fitted with a thermometer, a stirrer and a reflux condenser, the mixture is heated to a temperature of 150 to 250° C. under an inert gas atmosphere (of nitrogen gas or the like), and the reaction is continued until a predetermined acid value is reached, while by-product low molecular weight compounds are removed continuously from the reaction system. When the predetermined acid value is reached, the reaction is halted, the mixture is cooled, and the targeted reaction product is extracted.

Examples of catalysts that can be used in the synthesis of these polyester resins include antimony-based catalysts, tin-based catalysts, titanium-based catalysts and aluminum-based catalysts. Specific examples of these esterification catalysts include organometallic catalysts such as dibutyltin dilaurate and dibutyltin oxide, and metal alkoxides such as tetrabutyl titanate. From the viewpoints of environmental impact and safety, titanium-based catalysts and aluminum-based catalysts are preferred. The quantity added of these catalysts is preferably within a range from 0.01 to 1.00% by weight relative to the combined quantity of the raw materials.

In a non-crystalline resin polyester resin used in a toner of an exemplary embodiment of the present invention, measurement of the molecular weight of the tetrahydrofuran (THF) soluble fraction using gel permeation chromatography (GPC) preferably yields a weight average molecular weight (Mw) within a range from 5,000 to 50,000, and even more preferably from 7,000 to 20,000, a number average molecular weight (Mn) within a range from 2,000 to 10,000, and a molecular weight distribution Mw/Mn within a range from 1.5 to 10.

If the weight average molecular weight and number average molecular weight are smaller than the above ranges, then although the low-temperature fixability is favorable, the hot offset resistance deteriorates markedly, and the strength of the resin also falls, causing a deterioration in the strength of the image fixed on the paper. Furthermore, a small molecular weight also causes a decrease in the glass transition point, which has an undesirable effect on the toner storage properties and can lead to problems such as blocking. On the other hand, if the molecular weight values are larger than the above ranges, then although satisfactory hot offset resistance can be achieved, the low-temperature fixability deteriorates, and exudation of the crystalline polyester phase that exists within the toner is inhibited, which can have an undesirable effect on the storage properties of the document. Accordingly, ensuring the above conditions are met enables favorable levels of low-temperature fixability, hot offset resistance, and document storage stability to be achieved.

In an exemplary embodiment of the present invention, the molecular weight of a resin is determined by measuring the THF-soluble fraction of the resin, using a GPC-HLC-9120 apparatus and TSKgel Super HM-M column (15 cm) manufactured by Tosoh Corporation and using THF solvent as the eluent, and then calculating the molecular weight from a molecular weight calibration curve prepared using monodisperse polystyrene standards. The acid value of the polyester resin (the number of mg of KOH required to neutralize 1 g of the resin) is preferably within a range from 1 to 30 mgKOH/g, as such values enable a molecular weight distribution within the above range to be more easily obtained, enable the granulation properties of the toner particles generated by an emulsification dispersion method to be more easily maintained, and enable the environmental stability of the product toner (the stability of the toner chargeability upon variations in temperature and humidity) to be maintained at favorable levels.

The acid value of the polyester resin can be adjusted by controlling the quantity of carboxyl groups at the polyester terminals, by appropriate adjustments of the blend ratio between the polyvalent carboxylic acid and polyhydric alcohol raw materials and the reaction rate. Alternatively, a polyester containing carboxyl groups at non-terminal positions within the principal chain can be obtained by using trimellitic anhydride as the polyvalent carboxylic acid component.

In particular, coating layer non-crystalline resin polyesters preferably contain alkyl groups of 6 or more carbon atoms as side chains. By including such alkyl groups of 6 or more carbon atoms, the affinity of the resin for the crystalline resin described below can be enhanced, whereas positioning these alkyl groups as side chains prevents the co-solubility of the resin with the crystalline resin from becoming overly high, meaning the crystallinity of the crystalline resin is maintained, thus ensuring favorable low-temperature fixability. Polyesters containing alkyl groups of 6 or more carbon atoms can be obtained by using a monomer having an alkyl group of 6 or more carbon atoms as either the polyvalent carboxylic acid or the polyhydric alcohol. One suitable example is dodecenylsuccinic acid.

Preparation of a resin particle dispersion of a non-crystalline polyester resin can be achieved by appropriate adjustment of the resin acid value, and by conducting an emulsification dispersion using an ionic surfactant or the like.

Furthermore, in those cases where the resin is prepared by another method, provided the resin dissolves in an oil-based solvent that exhibits comparatively low solubility in water, a particle dispersion of the resin can be prepared by dissolving the resin in this type of oil-based solvent, adding the resulting solution to water together with an ionic surfactant and a polymer electrolyte, dispersing the resulting mixture to generate a particle dispersion in water using a dispersion device such as a homogenizer, and then evaporating off the solvent either by heating or under reduced pressure. Furthermore, a resin particle dispersion can also be prepared by adding a surfactant to the resin, and then using either an emulsification dispersion method or a phase inversion emulsification method to disperse the mixture in water with a dispersion device such as a homogenizer.

The particle size of a resin particle dispersion obtained in this manner can be measured, for example, using a laser diffraction particle size distribution analyzer (LA-700, manufactured by Horiba, Ltd.).

<Crystalline Resin>

As follows is a description of a crystalline resin in an exemplary embodiment of the present invention. The term "crystalline resin" refers to a material that exhibits a sharp endothermic peak when measured using differential scanning calorimetry (DSC). The "crystalline resin" used in an electrophotographic toner of the present invention refers to a resin that exhibits a sharp endothermic peak when measured using differential scanning calorimetry (DSC), and more specifically, refers to a resin for which the full width at half maximum of the endothermic peak obtained upon measurement at a rate of temperature increase of 10° C./minute is no more than 6° C.

—Crystalline Polyalkyl (meth)acrylate Resins—

A polyalkyl (meth)acrylate resin can be formed from the types of monomers described below. Namely, monomers such as lauryl acrylate, lauryl methacrylate, stearyl acrylate, stearyl methacrylate, arachidyl acrylate, arachidyl methacrylate, behenyl acrylate, behenyl methacrylate, lignoceryl acrylate and lignoceryl methacrylate, or alkyl (meth)acrylates with even longer alkyl chains. Long-chain alkyl (meth)acrylates may also include a mixture of materials with alkyl chains of different lengths. Long-chain alkyl groups of at least 18 carbon atoms but no more than 22 carbon atoms are particularly preferred. If the number of carbon atoms exceeds 22, then mixtures of the long-chain alkyl groups are difficult to obtain industrially, whereas if the number of carbon atoms is less than 18, the melting point of the resin is too low, meaning if an alkyl acrylate having an alkyl chain of less than 18 carbon atoms is included within a toner, the toner becomes prone to blocking inside the developing unit, and the printed image is more susceptible to offset problems.

By copolymerizing an aforementioned alkyl (meth)acrylate with a vinyl monomer having a carboxyl group, the type of crystalline resin required for the present invention can be obtained. Examples of this vinyl monomer having a carboxyl group include acrylic acid, methacrylic acid, β-carboxyethyl acrylate, β-carboxyethyl methacrylate, 4-carboxystyrene, 2-acryloyloxyethyl hydrogenphthalate, 2-acryloyloxypropyl hydrogenphthalate, 2-acryloyloxypropyl hexahydrohydrogenphthalate, 2-acryloyloxypropyl tetrahydrohydrogenphthalate, fumaric acid, maleic acid, 2-butene-1,4-dicarboxylic acid, and half ester products of fumaric acid, maleic acid and 2-butene-1,4-dicarboxylic acid, although this is not a restrictive list. The quantity used of this monomer having a carboxyl group within the copolymerization is preferably at least 10 mol % but no more than 50 mol % relative to the alkyl (meth)acrylate. Quantities within a range from 15 mol % to 40 mol % are even more preferred, and quantities from 20 mol % to 35 mol % are particularly desirable. If the copolymerization quantity of this monomer having a carboxyl group is too small, then the co-solubility between the crystalline resin and the non-crystalline resin deteriorates, making low-temperature fixability more difficult to achieve. In contrast, if the copolymerization quantity of the monomer having a carboxyl group is too large, then plasticization proceeds overly rapidly, which may cause the non-crystalline resin to become overly soft at room temperature, or cause a large difference to develop between the chargeability under low humidity conditions and the chargeability under high humidity conditions, making the resin effectively unusable.

Furthermore, the weight average molecular weight of the crystalline resin, measured using the measurement method described above, is typically within a range from 3,000 to 70,000, and preferably from 5,000 to 50,000. If the molecular weight is less than 3,000, then the strength of the image deteriorates, which may cause portions of the image to flake off when scratched or folded. In contrast, if the molecular weight exceeds 70,000, then considerable time is required to achieve co-solubility with the non-crystalline resin, which makes it more difficult to achieve low-temperature fixability.

The ratio between the non-crystalline resin and the crystalline resin is preferably within a range from 60/40 to 95/5, and is even more preferably within a range from 75/25 to 90/10. If the proportion of the non-crystalline resin is too low, then the strength of the toner itself decreases, which increases the likelihood of blocking and filming. If the proportion of the crystalline resin is too low, then achieving low-temperature fixability becomes more difficult.

The acid value of the crystalline resin (the number of mg of KOH required to neutralize 1 g of the resin) is preferably within a range from 2 to 120 mgKOH/g, as such values enable a molecular weight distribution within the above range to be more easily obtained, enable the granulation properties of the toner particles generated by an emulsification dispersion method to be more easily maintained, and enable the environmental stability of the product toner (the stability of the toner chargeability upon variations in temperature and humidity) to be maintained at favorable levels.

Although described in further detail below in relation to the manufacture of toner, the non-crystalline resin and crystalline resin may be used in combination with a colorant and/or a release agent, may be dissolved in a suitable solvent for blending, or may each be converted to an emulsion, subsequently mixed to form an aggregate, and then fused and blended. In the case of blending via this type of melt mixing, the toner is preferably prepared using a grinding method. When blending is conducted using solutions formed by dissolution in a solvent, a wet granulation toner manufacturing method that uses a solvent and a dispersion stabilizer is preferred, whereas when mixing is conducted using individually prepared emulsions, the toner is preferably prepared using an emulsion aggregation fusion method. In order to control the particle size and enable formation of a surface coating layer, the toner is preferably prepared using an emulsion aggregation fusion method.

<Emulsification of Crystalline Resin>

The viscosity of the polymer liquid is first lowered, either by heating the crystalline resin or by dissolving the polyester resin in an organic solvent, and mechanical shearing is then used to form emulsified particles. Phase inversion emulsification methods may also be used. However, from the viewpoint of limiting environmental contamination, the use of organic solvents is preferably avoided where possible. Furthermore, a dispersant may also be used to stabilize the emulsion particles and increase the viscosity of the water-based medium. Hereafter, the dispersion of these emulsified particles may also be referred to as a "resin particle dispersion".

Examples of the dispersant include water-soluble polymers such as polyvinyl alcohol, methylcellulose, ethylcellulose, hydroxyethylcellulose, carboxymethylcellulose, sodium polyacrylate and sodium polymethacrylate, as well as surfactants, including anionic surfactants such as sodium dodecylbenzenesulfonate, sodium octadecylsulfate, sodium oleate, sodium laurate and potassium stearate, cationic surfactants such as laurylamine acetate, stearylamine acetate and lauryltrimethylammonium chloride, amphoteric surfactants such as lauryldimethylamine oxide, and nonionic surfactants such as polyoxyethylene alkyl ethers, polyoxyethylene alkylphenyl ethers and polyoxyethylene alkylamines, as well as inorganic compounds such as tricalcium phosphate, aluminum hydroxide, calcium sulfate, calcium carbonate and barium carbonate.

In those cases where an inorganic compound is used as the dispersant, either commercially available compounds may be used as is, or a method that is capable of generating particles of the inorganic compound dispersant may be employed to reduce the size of the dispersant particles. The quantity used of the dispersant is preferably within a range from 0.01 to 20 parts by weight per 100 parts by weight of the crystalline resin.

Examples of suitable organic solvents include ethyl acetate and toluene, and this solvent should be selected in accordance with the nature of the crystalline resin.

The quantity used of the organic solvent is preferably within a range from 50 to 5,000 parts by weight, and even more preferably from 120 to 1,000 parts by weight, per 100 parts by weight of the combined weight of the crystalline resin and any other monomers that are used as required (hereafter, this combination may be referred to as simply "the polymer"). A colorant may also be added to the resin prior to formation of the emulsion particles. Examples of suitable colorants are listed in the section relating to colorants for an electrophotographic toner of the present invention.

Examples of suitable emulsification devices for use in forming the emulsion particles include a homogenizer, homomixer, cavitron, clearmix, pressure kneader, extruder and other media dispersion devices. The size of the emulsified particles (liquid droplets) of the polyester resin, reported as an average particle size (volume average particle size), is preferably within a range from 0.01 to 1 μm, even more preferably from 0.03 to 0.4 μm, and most preferably from 0.03 to 0.3 μm.

<Coloring Material>

There are no particular restrictions on the coloring materials (also referred to as "colorants") used in electrophotographic toners of exemplary embodiments of the present invention, and suitable examples include conventionally known colorants, which may be selected in accordance with the intended purpose of the toner. Single pigments may be used alone, or mixtures of two or more pigments of the same family may be used. Furthermore, mixtures of two or more pigments from different families may also be used. Specific examples of suitable colorants include carbon blacks such as furnace black, channel black, acetylene black and thermal black; inorganic pigments such as red iron oxide, iron blue, titanium oxide and magnetic powders; azo pigments such as fast yellow, monoazo yellow, disazo yellow, pyrazolone red, chelate red, brilliant carmine (such as 3B and 6B) and para brown; phthalocyanine pigments such as copper phthalocyanine and metal-free phthalocyanine; and condensed polycyclic pigments such as flavanthrone yellow, dibromoanthrone orange, perylene red, quinacridone red and dioxazine violet.

Further examples include various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green and malachite green oxalate; and various dyes such as acridine-based dyes, xanthene-based dyes, azo-based dyes, benzoquinone-based dyes, azine-based dyes, anthraquinone-based dyes, dioxazine-based dyes, thiazine-based dyes, azomethine-based dyes, indigo-based dyes, thioindigo-based dyes, phthalocyanine-based dyes, aniline black-based dyes, polymethine-based dyes, triphenylmethane-based dyes, diphenylmethane-based dyes and thiazole-based dyes. Black pigments such as carbon black or dyes may also be mixed with the colorant, provided no significant deterioration occurs in the degree of transparency. Moreover, disperse dyes and oil-soluble dyes may also be used.

The colorant content within an electrophotographic toner according to an exemplary embodiment of the present invention is preferably within a range from 1 to 30 parts by weight per 100 parts by weight of the binder resin, and within this numerical range, larger content values are preferred, provided no deterioration occurs in the smoothness of the image surface following fixing. Increasing the colorant content is advantageous in that the same image density can be achieved with a thinner image, which is effective in preventing offset. Each of the colored toners, namely yellow toner, magenta toner, cyan toner and black toner can be produced by appropriate selection of the colorant.

<Release Agent>

A release agent is generally used for improving the releasability. Specific examples of release agents include low molecular weight polyolefins such as polyethylene, polypropylene and polybutene; silicones that exhibit a softening point under heating; fatty acid amides such as oleoamide, erucaoamide, and stearoamide; vegetable waxes such as camauba wax, rice wax, candelilla wax, Japan wax and jojoba oil; animal waxes such as beeswax; mineral or petroleum waxes such as montan wax, ozokerite, ceresin, paraffin wax, microcrystalline wax and Fischer-Tropsch wax; and ester waxes such as fatty acid esters, montanate esters and carboxylate esters. In the present invention, these release agents may be used either alone, or in combinations of two or more different materials.

The quantity added of the release agent added is typically within a range from 0.5 to 50% by weight, preferably from 1 to 30% by weight, and even more preferably from 5 to 15% by weight relative to the total weight of the toner. If the quantity of the release agent is less than 0.5% by weight, then the effects of adding the release agent are minimal, whereas if the quantity exceeds 50% by weight, the chargeability is likely to be adversely affected, undesirable effects such as breakdown of the toner within the developing unit, the release agent becoming spent on the carrier, and deterioration in the chargeability become more likely, and in those cases where a color toner is used, inadequate permeation into the image surface during fixing becomes more likely, meaning the release agent may remain within the image, causing a deterioration in the transparency.

<Other Components>

There are no particular restrictions on other components that may be used in an electrophotographic toner according to an exemplary embodiment of the present invention, and such components may be selected according to need. Examples of these other components include conventional additives such as inorganic particles, organic particles, charge control agents and other release agents.

The inorganic particles mentioned above are typically added to a toner to improve the toner fluidity. Examples of suitable inorganic materials include particles of silica, alumina, titanium oxide, barium titanate, magnesium titanate, calcium titanate, strontium titanate, zinc oxide, silica sand, clay, mica, wollastonite, silious earth, cerium chloride, red iron oxide, chromium oxide, cerium oxide, antimony trioxide, magnesium oxide, zirconium oxide, silicon carbide and silicon nitride. Of these, silica particles are preferred, and hydrophobically treated silica particles are particularly desirable.

The primary particle size (number average particle size) of these inorganic particles is preferably within a range from 1 to 1,000 nm, and the quantity added (as an external additive) is preferably within a range from 0.01 to 20 parts by weight per 100 parts by weight of the toner.

Organic particles are typically added to improve the cleaning properties and transferability, and sometimes the chargeability, of the toner. Examples of suitable organic materials include particles of polystyrene, polymethylmethacrylate, polyvinylidene fluoride and polystyrene-acrylic copolymers.

Charge control agents are generally used for improving the chargeability of the toner. Examples of suitable charge control agents include metal salicylates, metal-containing azo compounds, nigrosine and quaternary ammonium salts.

<Other Configurations>

The surface of an electrophotographic toner of an exemplary embodiment of the present invention may be coated with a surface layer. The surface layer should preferably have no significant effect on the overall mechanical characteristics or melt viscoelasticity characteristics of the toner. Possible surface layers include a resin coating layer, a particle coating layer, and a chemical treatment coating layer, but if the crystalline material is exposed at the toner surface, then external additives may become embedded within the crystalline portion, making quality difficult to maintain. If the surface layer coats the toner too thickly, then the low-temperature fixability resulting from the use of the crystalline polyester resin may not manifest adequately. Accordingly, the film thickness of the surface layer is preferably kept as thin as possible, and is preferably within a range from 0.05 to 0.5 μm in the case of a resin coating layer, or no greater than 0.5 μm in the case of a particle coating layer.

In order to form a thin surface layer with a thickness that falls within the above range, particles that include the binder resin, other particles, a colorant, and any other inorganic particles or other materials that are added according to need are adhered or adsorbed to the surface of the toner, and the particles are then smoothed if required to form the coating layer. Furthermore, other methods may also be favorably employed, including adsorbing the raw material monomers of the resin to the toner and then forming a resin coating by graft polymerization, conducting an interfacial polymerization, or treating the toner surface chemically.

Examples of the components that constitute the surface layer include silane coupling agents, isocyanates, and vinyl-based monomers, resins and particles thereof.

Silane coupling agents are preferably used to treat the toner surface directly, thereby forming a coating. Isocyanates are preferably employed by incorporating a diamine and a dialcohol within the resin, and then effecting a polymerization at the toner interface. Furthermore, a coating layer formation method in which the polyester terminals are subjected to isocyanate modification, and the interface is then subjected to urea modification in water may also be used.

Examples of methods of chemically treating a vinyl-based monomer include oxidation methods, such as oxidation with powerful oxidizing agents such as peroxides, ozone oxidation or plasma oxidation, and methods in which a polymerizable monomer with a polar group is bonded via a graft polymerization or seed polymerization.

In an exemplary embodiment of the present invention, a resin coating layer is preferably formed using an aggregation method. The material of the coating layer is a non-crystalline resin, which may be selected from the same group of non-crystalline resins listed above for forming the core layer. The material groupings and material composition may be either the same as the aforementioned core, or different. If different, then because a coating layer may be impossible to form if the difference between the SP values (solubility parameters) of the core and the non-crystalline resin is too large, this SP value difference is preferably no greater than approximately 0.5.

In this description, the resin SP value refers to the Fedors parameter, which is calculated by the following formula using the method proposed by Fedors et al. [Polym. Eng. Sci., vol. 14, p. 147 (1974)]. Furthermore, the SP value can be calculated from the composition ratio of the raw material monomers, using the following formula.

$$SP\text{ value}=\sqrt{(Ev/v)}=\sqrt{(\Sigma\Delta ei/\Sigma\Delta vi)}$$

(wherein, Ev represents the evaporation energy (cal/mol), v represents the molar volume ($cm^3$/mol), Δei represents the evaporation energy of each atom or atomic group, and Δvi represents the molar volume of each atom or atomic group)

The difference in SP value between the non-crystalline resin C of the coating layer (the shell), and the non-crystalline resin B within the core particles is preferably no greater than 0.5. In other words:

(*SP* value of non-crystalline resin *C* of coating layer)−(*SP* value of non-crystalline resin *B* of core particles)≦0.5

Furthermore, the difference in SP value between the non-crystalline resin B within the core particles and the crystalline resin A within the core particles is preferably at least 0.3 but no greater than 0.5. In other words:

0.3≦(*SP* value of non-crystalline resin *B* of core particles)−(*SP* value of crystalline resin *A* of core particles)≦0.5

In addition, the conditions represented by the following equation are also preferably satisfied. Namely:

0.3≦(*SP* value of non-crystalline resin *B* of core particles)−(*SP* value of crystalline resin *A* of core particles)<(*SP* value of non-crystalline resin *C* of coating layer)−(*SP* value of non-crystalline resin *B* of core particles)≦0.5

By ensuring that the difference in SP values between the non-crystalline resin B and the crystalline resin A within the core particles is smaller than the difference in SP values between the non-crystalline resin C of the shell and the non-crystalline resin B of the core, the affinity of the non-crystalline resin B for the crystalline resin A of the core exceeds the affinity of the non-crystalline resin B for the non-crystalline resin C of the shell, meaning the crystalline resin A is more likely to be incorporated within the core. As a result, the crystalline resin A is not exposed at the toner surface, yielding a toner with superior charge retention and superior storage stability under heat. Moreover, by setting the upper limit for the difference in the SP values between the non-crystalline resin B within the core particles and the non-crystalline resin C of the shell to 0.5, favorable adhesiveness is retained between the core non-crystalline resin B and the shell non-crystalline resin C, whereas setting the lower limit for the difference in the SP values between the non-crystalline resin B and the crystalline resin A within the core particles to 0.3, the crystalline resin A of the core does not exhibit excessive co-solubility with the non-crystalline resin B, enabling more favorable low-temperature fixability to be obtained.

In those cases where a material such as those described above is adhered either chemically or physically to the surface of the toner particles to form a surface coating layer, the material may be coated onto the outside of the toner matrix particles by imparting a mechanical force to the resin particles and the toner, and this type of method is ideal for adjusting the charge characteristics of the toner matrix particles. Examples of the resin particles include styrene resins, styrene-acrylic copolymers and polyester resins. Examples of mixers that can be used during coating include a sample mill, Henschel mill, V-blender or hybridizer.

Furthermore other external additives including particles of metals, metal oxides, metal salts, ceramics, resins, resin particles or carbon black may also be added for the purposes of improving properties such as the chargeability, conductivity, powder fluidity and lubrication.

<Method of Manufacturing Toner>

Next is a description of a method of manufacturing toner according to an exemplary embodiment of the present invention.

There are no particular restrictions on a method of manufacturing toner according to an exemplary embodiment of the present invention, although wet manufacturing methods in which the toner particles are prepared in water, such as aggregation methods, suspension polymerization methods and solution polymerization methods offer better shape control, which yields toners less likely to suffer breakdown within the developing unit, and are consequently preferred. Aggregation fusion methods, which offer favorable shape control and resin coating layer formation are particularly desirable.

An aggregation method is a manufacturing method that includes: mixing together a resin particle dispersion produced by dispersing resin particles, a colorant particle dispersion produced by dispersing colorant particles, and a release agent particle dispersion produced by dispersing a release agent; forming an aggregate particle dispersion containing the resin particles, the colorant particles and the release agent particles, and fusing the aggregate particles by heating to a temperature at least as high as the glass transition point of the resin particles.

Specifically, the resin particle dispersion that includes an ionic surfactant is prepared using a typical emulsion polymerization, this dispersion is mixed with the colorant particle dispersion and the release agent particle dispersion, aggregate particles with a toner diameter are generated by hetero-aggregation with a coagulant with the opposite polarity to the ionic surfactant, heating is then conducted to a temperature at least as high as the glass transition point of the resin particles, thereby fusing the aggregate particles, and the fused particles are then washed and dried, yielding a toner.

In the aggregation step, in the early stages of mixing the crystalline and non-crystalline resin particle dispersion, the colorant particle dispersion and the release agent particle dispersion, first stage matrix aggregate particles may first be formed by shifting the balance between the quantities of each of the polar ionic surfactants, conducting an ionic neutralization by adding a polymer of an metal inorganic salt such as polyaluminum chloride, and then heating at a temperature below the glass transition point. Following stabilization of this dispersion, an additional resin particle dispersion that has been treated with an ionic dispersant of sufficient polarity and quantity to compensate the shift in the ionic balance may then be added as a second stage, the mixture may then be heated lightly, if required, at a temperature below the glass transition points of the resins contained within the resin particles of the aggregate and the additional resin particles, and then following stabilization at a higher temperature, heating may be conducted at a temperature higher than the glass transition points, thereby fusing the particles, with the additional particles added in the second stage of the aggregate formation still adhered to the surface of the first stage matrix aggregate particles. This multistage aggregation operation may also be repeated. The additional particles may be of a different material from the particles used during aggregation. This two stage method forms a coating layer, and improves the encapsulation of the crystalline resin, the release agent and the colorant.

Particularly in those cases where a vinyl-based monomer is used for the non-crystalline resin particles, an emulsion polymerization using an ionic surfactant or the like can be used for preparing the resin particle dispersion. In the case of other resins, provided the resin dissolves in an oil-based solvent that exhibits comparatively low solubility in water, the resin particle dispersion can be prepared by dissolving the resin in the oil-based solvent, adding the resulting solution to water together with an ionic surfactant and a polymer electrolyte, dispersing the resulting mixture to generate a particle dispersion in water, either by using a dispersion device such as a homogenizer or conducting a phase inversion emulsification, and then evaporating off the solvent either by heating or under reduced pressure.

Furthermore, the crystalline resin may be either dissolved and mixed into the resin particle dispersion, or mixed in during preparation of the release agent particle dispersion. This enables the crystalline resin to be blended into the toner.

The release agent is dispersed within the electrophotographic toner in the form of particles with a volume average particle size within a range from 150 to 1,500 nm, and by including from 1 to 25% by weight of such release agent particles, the releasability of the fixed image in an oil-less fixing method can be improved. A preferred range for the volume average particle size is from 160 to 1,400 nm, and a preferred addition quantity is from 5 to 20% by weight.

A dispersion of release agent particles of no more than 1 μm can be prepared by dispersing the release agent in water, together with an ionic surfactant and a polymer electrolyte such as a polymeric acid or polymeric base, and then heating to a temperature at least as high as the melting point, while effecting a dispersion to a particle form by using a homogenizer or pressure discharge disperser to impart a powerful shearing force.

The concentration of the surfactant used in the release agent dispersion is preferably no more than 4% by weight relative to the quantity of release agent. If this quantity exceeds 4% by weight, then the rate of aggregation during particle formation slows and the heating time lengthens, causing an undesirable increase in the level of aggregates.

Furthermore, the colorant is dispersed within the electrophotographic toner in the form of particles with a volume average particle size within a range from 100 to 330 nm, and by including from 4 to 15% by weight of such colorant particles, the coloring properties and the OHP transparency can be improved. A preferred range for the volume average particle size is from 120 to 310 nm, and a preferred addition quantity is from 5 to 14% by weight.

The colorant may be dispersed by conventional methods, and examples of particularly favorable dispersion devices include a revolving shearing homogenizer, media dispersers such as a ball mill, sand mill, attritor or coball mill, roll mills such as a triple roll mill, cavitation mills such as a nanomizer, a colloid mill, and a high pressure counter collision type disperser.

In a method of manufacturing toner according to an exemplary embodiment of the invention, examples of the surfactants that are used in the emulsion polymerization of the resin particles, the dispersion of the colorant, the addition and dispersion of the resin particles, the dispersion of the release agent, and the aggregation and stabilization of these dispersions include anionic surfactants such as sulfate ester-based surfactants, sulfonate ester-based surfactants, phosphate ester-based surfactants and soap-based surfactants, and cationic surfactants such as amine salt-based surfactants and quaternary ammonium salt-based surfactants. The use of non-ionic surfactants such as polyethylene glycol-based surfactants, alkylphenol ethylene oxide adduct-based surfactants or polyhydric alcohol-based surfactants in combination with the above ionic surfactants is also effective. Dispersion of these surfactants is generally conducted using a revolving shearing homogenizer, or a media-containing ball mill, sand mill or dyno mill.

Furthermore, in those cases where colorant particles coated with polar resin particles are used, a method in which the resin and the colorant are dissolved and dispersed in a solvent (such as water, a surfactant and an alcohol), and subsequently dispersed in water together with a suitable dispersant (including a surfactant), before the solvent is removed, either by heating or under reduced pressure, or a method in which the colorant particles are fixed on the surface of resin particles prepared by emulsion polymerization, either by a mechanical shearing force or by electrical adsorption, may be employed. These methods are effective in suppressing release of the colorant added to the aggregate particles, and in improving the dependency of the chargeability on the colorant.

Furthermore, the targeted toner is usually obtained by conducting arbitrary washing, solid-liquid separation and drying steps after the completion of the fusion process. In the washing step, thorough displacement washing with ion-exchanged water is preferably conducted to ensure favorable manifestation and retention of the chargeability characteristics. Although there are no particular restrictions on the solid-liquid separation, from the viewpoint of productivity, methods such as suction filtration, pressure filtration, centrifugal filtration and decanting are preferred. Moreover, although there are also no particular restrictions on the method using for the drying step, from the viewpoint of productivity, drying devices such as through-flow dryers, spray dryers, rotary dryers, flash dryers, fluidized-bed dryers, heat exchange dryers and freeze dryers are preferred.

Furthermore, in order to impart more favorable fluidity and improve the cleaning properties of the toner, metal salts such as calcium carbonate, metal oxide compounds such as silica, alumina, titania, barium titanate, strontium titanate, calcium titanate, cerium oxide, zirconium oxide and magnesium oxide, inorganic particles such as ceramics and carbon black, or resin particles such as vinyl resins, polyesters and silicones may be added to the toner surface in a dry state by application of shearing force, in a similar manner to that employed in conventional toner manufacturing methods.

These inorganic particles are preferably subjected to surface treatment with a coupling agent or the like to ensure better control of factors such as conductivity and chargeability. Specific examples of such coupling agents include silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,N-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-3,4-epoxychlorohexyl)ethyltrimethoxysilane, y-glycidoxypropyltrimethoxysilane, γ-glycidoxypropylmethyldiethoxysilane, γ-mercaptopropyltrimethoxysilane and γ-chloropropyltrimethoxysilane, as well as titanium coupling agents.

The method of adding these particles may involve either adhering the particles to the dried toner surface in a dry state using a mixer such as a V-blender or Henschel mixer, or dispersing the particles in water or a water-based liquid such as a water/alcohol mixture, adding the dispersion to a toner slurry, and then drying the mixture, thereby adhering the external additive to the toner surface. Furthermore, the addition may also be conducted by spraying a slurry onto dry powder, while simultaneously conducting drying.

Next is a description of a developer according to an exemplary embodiment of the present invention.

There are no particular restrictions on a developer according to an exemplary embodiment of the present invention, provided it includes an aforementioned toner of an exemplary embodiment of the present invention, and the composition of the developer may be determined in accordance with the intended purpose. A developer of this exemplary embodiment may be either a one-component developer in which the toner is used alone, or a two-component developer that uses a combination of the toner and a carrier.

There are no particular restrictions on the carrier, and conventional carriers such as the resin-coated carriers disclosed in Japanese Patent Laid-Open No. Sho 62-39879 and Japanese Patent Laid-Open No. Sho 56-11461 may be used.

Specific examples of suitable carriers include the resin-coated carriers described below. Examples of suitable core particle for these carriers include typical iron powder, ferrite and magnetite structures, and the volume average particle size of these core particles is typically within a range from approximately 30 to 200 μm.

Examples of the coating resin for the resin-coated carrier include homopolymers or copolymers of two or more monomers selected from amongst styrenes such as styrene, parachlorostyrene and α-methylstyrene, α-methylene fatty acid monocarboxylates such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acrylate compounds such as dimethylaminoethyl methacrylate; vinylnitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; olefins such as ethylene and propylene; and vinyl-based fluorine-containing monomers such as vinylidene fluoride, tetrafluoroethylene and hexafluoroethylene; as well as silicone resins containing methylsilicone or methylphenylsilicone or the like, polyesters containing bisphenol or glycol; epoxy resins, polyurethane resins, polyamide resins, cellulose resins, polyether resins, and polycarbonate resins. These resins may be used either alone or in combinations of two or more different resins. The quantity of the coating resin is preferably within a range from approximately 0.1 to 10 parts by weight, and even more preferably from 0.5 to 3.0 parts by weight, per 100 parts by weight of the core particles.

Production of the carrier can be conducted using a heated kneader, a heated Henschel mixer or a UM mixer or the like. Depending on the quantity of the coating resin, a heated fluidized rolling bed or heated kiln or the like may also be used.

In a developer according to the present invention, there are no particular restrictions on the mixing ratio between the toner and the carrier, which can be selected appropriately in accordance with the intended application.

<Image Forming Method>

As follows is a description of an image forming method according to an exemplary embodiment of the present invention.

An image forming method of the present invention includes: forming an electrostatic latent image on the surface of a latent image holding member, developing the electrostatic latent image formed on the surface of the latent image holding member using a developer supported on a developer carrier, thereby forming a toner image, transferring the toner image formed on the surface of the latent image holding member to the surface of a transfer target, and heat fixing the toner image transferred to the surface of the transfer target, wherein the developer contains at least an electrophotographic toner according to the present invention. The developer may be either a one-component system or a two-component system.

Each of the above steps can use conventional processes from known image forming methods.

An electrophotographic photoreceptor or a dielectric recording material may be used as the latent image holding member. In the case of an electrophotographic photoreceptor, the surface of the electrophotographic photoreceptor is charged uniformly using a corotron charger or a contact charger or the like, and is then exposed to form an electrostatic latent image (the latent image-forming step). Subsequently, toner particles are adhered to the electrostatic latent image by bringing the image either into contact with, or into close proximity to, a developing roller on which has been formed a developer layer, thereby forming a toner image on the electrophotographic photoreceptor (the developing step). The thus formed toner image is then transferred to the surface of a transfer target material such as a sheet of paper using a corotron charger or the like (the transfer step). The toner image that has been transferred to the surface of the transfer target is subsequently subjected to heat fixing using a fixing device, thereby forming the final toner image.

During heat fixing by the above fixing device, a release agent is usually supplied to the fixing member of the above fixing device in order to prevent offset problems and the like.

There are no particular restrictions on the method used for supplying the release agent to the surface of the roller or belt that functions as the fixing member during heat fixing, and suitable methods include a pad system that uses a pad impregnated with the liquid release agent, a web system, a roller system, and a non-contact shower system (a spray system), although of these, a web system or roller system is preferred. These systems offer the advantages that the release agent can be supplied uniformly, and the quantity of release agent supplied can be readily controlled. If a shower system is used, then a separate blade or the like should be used to ensure that the release agent is supplied uniformly across the entire fixing member.

FIG. 1 is a schematic illustration showing a sample configuration of an image formation apparatus that forms an image using an image forming method according to an exemplary embodiment of the present invention. The image formation apparatus 200 shown in the drawing includes an photoreceptor 201, a charger 202, an image writing device 203, a rotary developing device 204, a primary transfer roller 205, a cleaning blade 206, an intermediate transfer member 207, multiple (three in the drawing) support rollers 208, 209 and 210, and a secondary transfer roller 211.

The photoreceptor 201 is formed in the shape of a drum, and has a photosensitive layer around the outer periphery (the drum surface). This photoreceptor 201 is disposed so as to be rotatable in the direction of the arrow C shown in FIG. 1. The charger 202 is used to charge the photoreceptor 201 uniformly. The image writing device 203 is used to form an electrostatic image by irradiating an imaging light onto the photoreceptor 201 that has been uniformly charged by the charger 202.

The rotary developing device 204 is provided with four developing units 204Y, 204M, 204C and 204K which house a yellow toner, a magenta toner, a cyan toner and a black toner respectively. In this device, toners are used as the developers for forming an image, and therefore the yellow toner is housed in the developing unit 204Y, the magenta toner is housed in the developing unit 204M, the cyan toner is housed in the developing unit 204C, and the black toner is housed in the developing unit 204K respectively. The rotary developing device 204 is rotated so as to sequentially position each of the four developing units 204Y, 204M, 204C and 204K in a position opposing the photoreceptor 201 at close proximity, and each toner is transferred to an electrostatic latent image corresponding with that color, thereby forming a toner image.

The primary transfer roller 205 presses the intermediate transfer member 207 against the photoreceptor 201, and transfers the toner image formed on the surface of the photoreceptor 201 to the outer peripheral surface of the intermediate transfer member 207, which is shaped as an endless belt (the primary transfer). The cleaning blade 206 is used for cleaning off (removing) any toner left on the surface of the photoreceptor 201 following transfer. The intermediate transfer member 207 is supported under tension by multiple rollers 208, 209 and 210 that contact the inner peripheral surface of the transfer member 207, and is able to be rotated in both the direction indicated by the arrow D and the reverse direction. The secondary transfer roller 211 sandwiches a recording paper (the image output medium), which is transported in the direction of the arrow E by a paper transport device not shown in the drawing, against the support roller 210, and transfers the toner image that has been transferred to the outer peripheral surface of the intermediate transfer member 207 to the recording paper (the secondary transfer).

The image formation apparatus 200 is used to sequentially form toner images on the surface of the photoreceptor 201, and then transfer and superimpose these images on the outer peripheral surface of the intermediate transfer member 207. The apparatus is operated in the manner described below. Namely, the photoreceptor 201 is first rotated, and the surface of the photoreceptor 201 is charged uniformly by the charger 202. Subsequently, the photoreceptor 201 is irradiated with image light by the image writing device 203, thereby forming an electrostatic latent image. This electrostatic latent image is developed by the yellow developing unit 204Y and the resulting toner image is transferred to the outer peripheral surface of the intermediate transfer member 207 by the primary transfer roller 205. Any residual yellow toner which is not transferred to the intermediate transfer member 207 and remains on the surface of the photoreceptor 201 is removed by the cleaning blade 206. The intermediate transfer body 207 with the yellow toner image formed on the outer peripheral surface thereof is then rotated in the reverse direction to that indicated by the arrow D, with the yellow toner image retained on the outer peripheral surface thereof, and is positioned so that the subsequent magenta toner image is transferred and superimposed on top of the yellow toner image.

Subsequently, the above operation of charging using the charger 202, irradiation with image light using the image writing device 203, formation of a toner image using each of the developing units 204M, 204C and 204K, and transfer of the toner image to the outer peripheral surface of the intermediate transfer member 207 is repeated for the magenta, cyan and black toners respectively.

In this manner, a full color image containing the toner images of all four colors superimposed is formed on the outer peripheral surface of the intermediate transfer member 207. This full color toner image is transferred to the recording paper in a single step using the secondary transfer roller 211. This enables a full color recorded image to be produced on the image formation surface of the recording paper.

In FIG. 1, following transfer of the toner image to the recording paper (one example of an image output medium) using the secondary transfer roller 211, the toner image is subjected to heat fixing at a temperature within a range from 110 to 200° C., and preferably from 110 to 160° C.

Examples of suitable transfer target materials (recording materials) to which the toner image can be transferred include the types of normal paper and OHP sheets and the like used in electrophotographic copying machines and printers and the like.

EXAMPLES

As follows is a more detailed description of the present invention based on a series of examples, although the present invention is in no way limited by these examples.

First is a description of each of the measurements conducted in the examples.

—Method of Measuring Particle Size and Particle Size Distribution—

As follows is a description of the measurement of particle size (also referred to as particle diameter) and particle size distribution (also referred to as particle diameter distribution).

In those cases where the particle size to be measured is 2 μm or greater, measurement is conducted using a Coulter Counter TA-II (manufactured by Beckman Coulter, Inc.), using Isoton-II (manufactured by Beckman Coulter, Inc.) as the electrolyte.

The measurement method involves adding from 0.5 to 50 mg of the measurement sample to a surfactant as the dispersant (2 ml of a 5% aqueous solution of a sodium alkylbenzenesulfonate is preferred), and then adding this sample to 100 ml of the above electrolyte.

The electrolyte containing the suspended sample is subjected to dispersion treatment for approximately one minute in an ultrasound disperser, and then using the aforementioned Coulter Counter TA-II, the particle size distribution is measured for particles from 2 to 60 μm using an aperture size of 100 μm, and the volume average particle distribution and the number average particle distribution are then determined. The number of particles measured is 50,000.

Furthermore, the toner particle size distribution is determined in the following manner. Namely, the previously measured particle size distribution is divided into particle size ranges (channels), and a volume cumulative distribution curve is drawn beginning at the smaller particle sizes. On this curve, the particle size at the point where the accumulated number of particles reaches 16% is defined as D16p, and the particle size at the point where the accumulated particle volume reaches 50% is defined as D50v. Similarly, the particle size at the point where the accumulated number of particles reaches 84% is defined as D84p.

In the present invention, the volume average particle size refers to D50v, and the number average particle size distribution index on the low particle size side GSDp-low is calculated using the formula shown below.

$$GSDp\text{-low}=\{(D84p)/(D16p)\}^{0.5}$$

In those cases where the particle size to be measured is less than 2 μm, measurement is conducted using a laser diffraction particle size distribution analyzer (LA-700, manufactured by Horiba, Ltd.). The measurement method involves adjusting the dispersion-state sample so that the solid fraction of the sample is approximately 2 g, and then adding ion-exchanged water to make the sample up to approximately 40 ml. This sample is then added to the cell in sufficient quantity to generate a suitable concentration, the sample is then to stand for approximately 2 minutes until the concentration within the cell has substantially stabilized, and the measurement is then conducted. The volume average particle size for each of the obtained channels is accumulated beginning at the smaller volume average particle sizes, and the point where the accumulated volume reaches 50% is defined as the volume average particle size.

In the case of the measurement of a powder of an external additive or the like, 2 g of the sample for measurement is added to a surfactant (50 ml of a 5% aqueous solution of a sodium alkylbenzenesulfonate is preferred), and the resulting mixture is dispersed for two minutes using an ultrasound dispersion device (1,000 Hz), thereby yielding a sample. This sample is then measured in the same manner as the dispersion described above.

—Method of Measuring Shape Factor SF1—

The shape factor SF1 of a toner is a shape factor SF that indicates the degree of unevenness on the surface of the toner particles, and is calculated using the formula shown below.

$$SF1=(ML^2/A)\times(\pi/4)\times 100$$

In this formula, ML represents the maximum length of a toner particle, and A represents the projected area of the toner particle. Measurement of the shape factor SF1 is conducted by first loading an optical microscope image of a toner scattered on a slide glass into an image analyzer via a video camera, subsequently calculating the SF value for at least 50 toner particles, and then determining the average value of these calculated shape factor values.

—Method of Measuring Molecular Weight and Molecular Weight Distribution for Toners and Resin Particles—

Measurements of the molecular weight distribution are conducted under the following conditions. Namely, the GPC is conducted using devices HLC-8120GPC and SC-8020 (manufactured by Tosoh Corporation), two columns (TSK-gel, Super HM-H, manufactured by Tosoh Corporation, 6.0 mmID×15 cm), and using THF (tetrahydrofuran) as the eluent. Testing is conducted under conditions including a sample concentration of 0.5%, a flow rate of 0.6 ml/minute, a sample injection volume of 10 μl, and a measurement temperature of 40° C., using an IR detector. Furthermore, the calibration curve is prepared using 10 polystyrene TSK standards manufactured by Tosoh Corporation: A-500, F-1, F-10, F-80, F-380, A-2500, F-4, F-40, F-128 and F-700.

—Method of Measuring Melting Point and Glass Transition Temperature—

The melting point and glass transition temperature of the toner are determined using a DSC (differential scanning calorimetry) measurement method, and are determined from the subjective maximum peak, measured in accordance with ASTM D3418-8.

Measurement of the subjective maximum peak can be conducted using a DSC-7 manufactured by PerkinElmer Inc. In this device, temperature correction at the detection portion is conducted using the melting points of indium and zinc, and correction of the heat quantity is conducted using the heat of fusion of indium. The sample is placed in an aluminum pan, and using an empty pan as a control, measurement is conducted at a rate of temperature increase of 10° C./minute.

—Method of Measuring Acid Value—

Approximately 1 g of the resin is weighed accurately and dissolved in 80 ml of tetrahydrofuran. Phenolphthalein is added as an indicator, and then a titration is performed using an ethanol solution containing 0.1N KOH, with the end point being determined as the point at which the color is retained for 30 seconds. The quantity used of the 0.1N KOH ethanol solution is then used to calculate the acid value (the number of mg of KOH required to neutralize the free fatty acid incorporated within 1 g of the resin, as defined in JIS K0070:92).

—Identification of Crystalline Resin within Toner—

(i) Identification of polyalkyl (meth)acrylates and the number of carbon atoms within the alkyl group The toner is dissolved in THF solvent, and any sediment is removed by filtration. Using the GPC devices described above (HLC-8120GPC and SC-8020 (manufactured by Tosoh Corporation)), using two columns (TSKgel, Super HM-H, manufactured by Tosoh Corporation, 6.0 mmID×15 cm), and using THF (tetrahydrofuran) as the eluent, the resin and the release agent are separated. The thus separated resin fraction is dissolved in THF-d8, and the structure is determined using a nuclear magnetic resonance apparatus (NMR) (JMN-AL400, manufactured by JEOL Ltd.)

Furthermore, 1 microliter of the alcohol obtained by adding sodium hydroxide to the resin solution to effect hydrolysis is injected into a gas chromatograph for analysis. The gas chromatograph used is a GC-17A manufactured by Shimadzu Corporation, and analysis is conducted under the conditions listed below.

Column: TC-1 60 m

Injection temperature: 200° C.

Conditions for temperature increase: 5 minutes at 40° C., then the temperature is raised to 140° C. at 4° C./minute Detector: FID (ii) Identification of Quantity of Vinyl Monomer having a Carboxyl Group—

The acid value of the resin that has been separated from the release agent by GPC in the manner described above is measured using the aforementioned method of measuring acid values. If the acid value is within a range from 20 to 120 mgKOH/g, then the quantity of the vinyl monomer having a carboxyl group within the crystalline resin is deemed to be at least 10 mol % but no more than 50 mol %. Multiple toner samples containing a crystalline resin are prepared in advance using each of the aforementioned vinyl monomers, and measurement of the acid values of these samples is used to confirm that if the acid value is within a range from 20 to 120 mgKOH/g, then the quantity of the vinyl monomer having a carboxyl group within the crystalline resin is at least 10 mol % but no more than 50 mol %.

—Measurement of Endothermic Peaks derived from Crystalline resin and Release Agent within the Toner using Differential Scanning Calorimetry—

Endothermic peaks and heat absorption quantities derived from the crystalline resin and release agent within the toner are measured by thermal analysis using a differential scanning calorimeter (DSC-60A, manufactured by Shimadzu Corporation) (hereafter also abbreviated as "DSC"). The measurement involves raising the temperature from room temperature to 150° C. at a rate of 10° C./minute in a first temperature raising step, holding the temperature at 150° C. for 5 minutes, subsequently using liquid nitrogen to cool the temperature to 0° C. at a rate of 10° C./minute, holding the temperature at 0° C. for 5 minutes, and then reheating the sample and raising the temperature from 0° C. to 150° C. at a rate of 10° C./minute in a second temperature raising step.

—Toner Charge Quantity—

1.5 parts by weight of the electrostatic latent image toner and 30 parts by weight of ferrite particles coated with a styrene/methyl methacrylate resin (average particle size: 35 μm) are weighed into a glass bottle having a lid. Following seasoning for 24 hours under either high temperature, high humidity conditions (temperature: 28° C., humidity: 85%) or low temperature, low humidity conditions (temperature: 10° C., humidity: 15%), the sample is shaken and mixed for 5 minutes using a Turbula mixer. The charge quantity (μC/g) of the toner under both sets of conditions is measured a blow-off charge quantity tester. The charge quantity of an electrostatic latent image toner according to the present invention, reported as an absolute value, is preferably within a range from 20 to 50 μC/g, and even more preferably from 25 to 45 μC/g. If this charge quantity is less than 20 μC/g, then background staining (fogging) becomes more likely, whereas if the charge quantity exceeds 50 μC/g, the image density becomes prone to deterioration.

—Measurement of Powder Characteristics—

Using a powder tester (manufactured by Hosokawa Micron Corporation) and with three sieves having mesh sizes of 53 μm, 45 μm and 38 μm arranged in series in that order, a sample of the electrostatic latent image toner is placed on top of the 53 μm sieve, and the sieve arrangement is vibrated with an amplitude of 1 mm for 90 seconds. Following this vibration, the weight of toner sitting on each sieve is measured, and subsequently multiplied by a weighting of 0.5, 0.3 and 0.1 respectively. The weighted values are then added together to generate a percentage. Measurement of the degree of heat aggregation is conducted using a toner sample that has been left to stand for approximately 24 hours under conditions including a temperature of 55° C. and a humidity of 50% RH, and the measurement itself is then conducted in an environment at 25° C. and 50% RH.

<Synthesis of Crystalline Resins and Preparation of Latexes>

<Crystalline Resin 1>

34.7 parts by weight of behenyl acrylate, 3.22 parts by weight of acrylic acid (30 mol % of the total quantity of monomers) and 0.72 parts by weight of dodecanethiol are dissolved in 75 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding an acrylic acid-behenyl acrylate copolymer (1). The weight average molecular weight, measured by GPC against polystyrene standards, is 14,800. The acid value is 61 mgKOH/g, and the melting point is 66° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (1) with a volume average particle size of 300 nm.

<Crystalline Resin 2>

36.4 parts by weight of behenyl methacrylate, 3.9 parts by weight of methacrylic acid (30 mol % of the total quantity of monomers) and 0.72 parts by weight of dodecanethiol are dissolved in 75 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding a methacrylic acid-behenyl methacrylate copolymer (2). The weight average molecular weight, measured by GPC against polystyrene standards, is 16,200. The acid value is 63 mgKOH/g, and the melting point is 52° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (2) with a volume average particle size of 250 nm.

<Crystalline Resin 3>

24.8 parts by weight of behenyl acrylate, 5.4 parts by weight of acrylic acid (50 mol % of the total quantity of monomers) and 0.72 parts by weight of dodecanethiol are dissolved in 50 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding an acrylic acid-behenyl acrylate copolymer (3). The weight average molecular weight, measured by GPC against polystyrene standards, is 14,000. The acid value is 101 mgKOH/g, and the melting point is 67° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (3) with a volume average particle size of 200 nm.

<Crystalline Resin 4>

46.1 parts by weight of behenyl acrylate, 4.44 parts by weight of acrylic acid (30 mol % of the total quantity of monomers) and 4.08 parts by weight of dodecanethiol are dissolved in 80 parts by weight of toluene, 1.0 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding an acrylic acid-behenyl acrylate copolymer (4). The weight average molecular weight, measured by GPC against polystyrene standards, is 5,900. The acid value is 58 mgKOH/g, and the melting point is 63° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (4) with a volume average particle size of 180 nm.

<Crystalline Resin 5>

47.1 parts by weight of behenyl acrylate, 0.54 parts by weight of acrylic acid (5 mol % of the total quantity of monomers) and 0.72 parts by weight of dodecanethiol are dissolved in 80 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding an acrylic acid-behenyl acrylate copolymer (5). The weight average molecular weight, measured by GPC against polystyrene standards, is 16,000. The acid value is 9 mgKOH/g, and the melting point is 66° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (5) with a volume average particle size of 300 nm.

<Crystalline Resin 6>

34.7 parts by weight of behenyl acrylate, 3.87 parts by weight of methyl acrylate (30 mol % of the total quantity of monomers) and 0.72 parts by weight of dodecanethiol are dissolved in 80 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding a methyl acrylate-behenyl acrylate copolymer (6). The weight average molecular weight, measured by GPC against polystyrene standards, is 12,000. The acid value is 58 mgKOH/g, and the melting point is 63° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (6) with a volume average particle size of 250 nm.

<Crystalline Resin 7>

A heat-dried flask is charged with 75 parts by weight of sebacic acid and 40 parts by weight of ethylene glycol, 0.05 parts by weight dibutyltin oxide is added, nitrogen gas is introduced into the flask, and with the inside of the flask maintained under an inert atmosphere, the temperature is raised and a co-condensation polymerization reaction is conducted for approximately 12 hours at 150 to 230° C. Subsequently, with the temperature held at 210 to 250C, the pressure is gradually reduced, thus synthesizing a crystalline polyester resin (7). Measurement of the molecular weight (relative to polystyrene standards) using gel permeation chromatography reveals a weight average molecular weight (Mw) for the crystalline polyester resin (7) of 20,300 and a number average molecular weight (Mn) of 8,700.

30 parts by weight of thecrystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (7) with a volume average particle size of 300 nm.

<Crystalline Resin 8>

40.1 parts by weight of behenyl acrylate, 1.54 parts by weight of acrylic acid (15 mol % of the total quantity of monomers) and 0.72 parts by weight of dodecanethiol are dissolved in 85 parts by weight of toluene, 0.75 parts by weight of the radical initiator azobisisobutyronitrile (AIBN) is added, and the resulting mixture is reacted for 16 hours at 70° C. under an atmosphere of nitrogen. Subsequently, the product is precipitated in 1 liter of methanol, and is then dried, thereby yielding an acrylic acid-behenyl acrylate copolymer (8). The weight average molecular weight, measured by GPC against polystyrene standards, is 16,600. The acid value is 30 mgKOH/g, and the melting point is 65° C.

30 parts by weight of the crystalline resin and 1.5 parts by weight of an anionic surfactant (sodium dodecylbenzenesulfonate) is added to 150 parts by weight of ion-exchanged water, the mixture is heated to 90° C., and an emulsification device (Ultra Turrax T-50, manufactured by IKA Works Inc.) is used to stir the mixture at 8,000 rpm, thus preparing a crystalline resin latex (8) with a volume average particle size of 300 nm.

<Non-Crystalline Resin 1>

A heat-dried flask is charged with 35 molar parts of polyoxyethylene (2,0)-2,2-bis(4-hydroxyphenyl)propane, 65 molar parts of polyoxypropylene (2,2)-2,2-bis(4-hydroxyphenyl)propane, 80 molar parts of terephthalic acid, 10 molar parts of n-dodecenylsuccinic acid, 10 molar parts of isophthalic acid and 0.05 molar parts of dibutyltin oxide relative to these acid components (the combined number of mols of terephthalic acid, n-dodecenylsuccinic acid and isophthalic acid). Nitrogen gas is introduced into the flask, and with the inside of the flask maintained under an inert atmosphere, the temperature is raised and a co-condensation polymerization reaction is conducted for approximately 12 hours at 150 to 230° C. Subsequently, with the temperature held at 210 to 250° C., the pressure is gradually reduced, thus synthesizing a non-crystalline polyester resin (1). Measurement of the molecular weight (relative to polystyrene standards) using gel permeation chromatography reveals a weight average molecular weight (Mw) for the non-crystalline polyester resin (1) of 15,400 and a number average molecular weight (Mn) of 6,800.

Furthermore, the DSC spectrum of the non-crystalline polyester resin (1) is measured using a differential scanning calorimeter (DSC), in the same manner as that described above for measurement of the melting point, but no clear peak is displayed, and a step-wise change in the quantity of heat absorption is observed. The glass transition point, which is taken as the middle point in this step-wise change in the heat absorption quantity, is 65° C.

30 parts by weight of the non-crystalline polyester resin (1) is dissolved in 100 parts by weight of ethyl acetate, 1.5 parts by weight of an anionic surfactant (sodium dodecylbenzenesulfonate) and 150 parts by weight of ion-exchanged water are added, the mixture is heated to 60° C., an emulsification device (Ultra Turrax T-50, manufactured by IKA Works Inc.) is used to stir the mixture at 8,000 rpm, and the ethyl acetate is then removed by evaporation, thus preparing a non-crystalline resin latex (1) with a volume average particle size of 180 nm.

<Non-Crystalline Resin 2>

| | |
|---|---|
| Styrene | 360 parts by weight |
| n-butyl acrylate | 40 parts by weight |
| Acrylic acid | 6 parts by weight |
| Dodecanethiol | 24 parts by weight |
| Carbon tetrabromide | 4 parts by weight |

The above components are mixed and dissolved, and then dispersed and emulsified in a flask containing 8 parts by weight of a non-ionic surfactant (Nonipol 400, manufactured by Sanyo Chemical Industries, Ltd.) and 12 parts by weight of an anionic surfactant (Neogen SC, manufactured by Dai-ichi Kogyo Seiyaku Co., Ltd.) dissolved in 550 parts by weight of ion-exchanged water. Subsequently, 50 parts by weight of ion-exchanged water containing 4 parts by weight of ammonium persulfate dissolved therein is added gradually while the dispersion in the flask is stirred slowly for 10 minutes. After flushing the system thoroughly with nitrogen, the flask is placed in an oil bath and the internal temperature of the system is heated to 70° C. with constant stirring, and the emulsion polymerization is then allowed to progress at this temperature for 5 hours. Subsequently, the reaction product is cooled to room temperature, yielding a non-crystalline resin particle dispersion (2) containing resin particles with a glass transition point of 60.5° C., a weight average molecular weight of 19,000 and a number average molecular weight (Mn) of 7,300.

<Non-Crystalline Resin 3>

A heat-dried flask is charged with 50 molar parts of polyoxyethylene (2,0)-2,2-bis(4-hydroxyphenyl)propane, 50 molar parts of polyoxypropylene (2,2)-2,2-bis(4-hydroxyphenyl)propane, 80 molar parts of terephthalic acid, 20 molar parts of isophthalic acid and 0.05 molar parts of dibutyltin oxide relative to these acid components (the combined number of mols of terephthalic acid and isophthalic acid). Nitrogen gas is introduced into the flask, and with the inside of the flask maintained under an inert atmosphere, the temperature is raised and a co-condensation polymerization reaction is conducted for approximately 12 hours at 150 to 230° C. Subsequently, with the temperature held at 210 to 250° C., the pressure is gradually reduced, thus synthesizing a non-crystalline polyester resin (3). Measurement of the molecular weight (relative to polystyrene standards) using gel permeation chromatography reveals a weight average molecular weight (Mw) for the non-crystalline polyester resin (3) of 10,500 and a number average molecular weight (Mn) of 4,600.

Furthermore, the DSC spectrum of the non-crystalline polyester resin (3) is measured using a differential scanning calorimeter (DSC), in the same manner as that described above for measurement of the melting point, but no clear peak is displayed, and a step-wise change in the quantity of heat absorption is observed. The glass transition point, which is taken as the middle point in this step-wise change in the heat absorption quantity, is 65° C.

30 parts by weight of the non-crystalline polyester resin (3) is dissolved in 100 parts by weight of ethyl acetate, 1.5 parts by weight of an anionic surfactant (sodium dodecylbenzenesulfonate) and 150 parts by weight of ion-exchanged water are added, the mixture is heated to 60° C., an emulsification device (Ultra Turrax T-50, manufactured by IKA Works Inc.) is used to stir the mixture at 8,000 rpm, and the ethyl acetate is then removed by evaporation, thus preparing a non-crystalline resin latex (3) with a volume average particle size of 190 nm.

—Preparation of Pigment Dispersion—

—Preparation of Cyan Colorant Dispersion—

| | |
|---|---|
| C.I. Pigment Blue 15:3 (copper phthalocyanine, manufactured by Dainippon Ink and Chemicals, Incorporated) | 50 parts by weight |
| Anionic surfactant Neogen SC (manufactured by Dai-ichi Kogyo Seiyaku Co., Ltd.) | 5 parts by weight |
| Ion-exchanged water | 200 parts by weight |

The above components are mixed together and dissolved, and then dispersed for 10 minutes using a homogenizer (Ultra Turrax, manufactured by IKA Works Inc.), yielding a cyan colorant dispersion with a center particle size of 175 nm and a solid fraction of 22.5% by weight.

—Preparation of Yellow Colorant Dispersion—

| | |
|---|---|
| C.I. Pigment Yellow 74 (manufactured by Clariant Ltd.) | 60 parts by weight |
| Ionic surfactant Neogen RK (manufactured by Dai-ichi Kogyo Seiyaku Co., Ltd.) | 7 parts by weight |
| Ion-exchanged water | 200 parts by weight |

The above components are mixed together and dissolved, and then dispersed for 10 minutes using a homogenizer (Ultra Turrax, manufactured by IKA Works Inc.), yielding a yellow colorant dispersion with a center particle size of 150 nm and a solid fraction of 24.5% by weight.

—Preparation of Magenta Colorant Dispersion—

| | |
|---|---|
| C.I. Pigment Red 122 (manufactured by Clariant Ltd.) | 50 parts by weight |
| Ionic surfactant Neogen RK (manufactured by Dai-ichi Kogyo Seiyaku Co., Ltd.) | 6 parts by weight |
| Ion-exchanged water | 200 parts by weight |

The above components are mixed together and dissolved, and then dispersed for 10 minutes using a homogenizer (Ultra Turrax, manufactured by IKA Works Inc.), yielding a magenta colorant dispersion with a center particle size of 185 nm and a solid fraction of 23.5% by weight.

—Preparation of Black Colorant Dispersion—

| | |
|---|---|
| Carbon black: Regal 330 (manufactured by Cabot Corporation) | 50 parts by weight |
| Ionic surfactant Neogen RK (manufactured by Dai-ichi Kogyo Seiyaku Co., Ltd.) | 6 parts by weight |
| Ion-exchanged water | 200 parts by weight |

The above components are mixed together and dissolved, and then dispersed for 10 minutes using a homogenizer (Ultra Turrax, manufactured by IKA Works Inc.), yielding a black colorant dispersion with a center particle size of 240 nm and a solid fraction of 24.0% by weight.

—Preparation of Release Agent Dispersion—

| | |
|---|---|
| Wax (WEP-2) (manufactured by NOF Corporation) | 25 parts by weight |
| Anionic surfactant Neogen SC (manufactured by Dai-ichi Kogyo Seiyaku Co., Ltd.) | 5 parts by weight |
| Ion-exchanged water | 200 parts by weight |

The above components are heated to 95° C., dispersed thoroughly using an Ultra Turrax T50, manufactured by IKA Works Inc., and subsequently subjected to further dispersion treatment using a pressure discharge disperser (Gaulin homogenizer), thereby yielding a wax dispersion with a center diameter of 215 run and a solid fraction of 9.5% by weight.

Example 1

<Preparation of Toner (1)>

—Preparation of Electrophotographic Toner (1)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 400 parts by weight |
| Crystalline resin latex (1) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. Inspection of the contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of this electrophotographic toner (1) using a Coulter Counter reveals a volume average particle size of 6.4 μm. Furthermore, the volume GSD, which is an indicator of the volumetric particle size distribution, is 1.25.

The volume GSD can be determined from the volume average particle size distribution curve measured using a Coulter Counter, by determining the volume average particle size D84 at 84% and the volume average particle size D16 at 16%, and then inserting these particle size values within the formula $(D84/D16)^{1/2}$. Furthermore, the above volume average particle sizes represent 50% volume average particle sizes D50.

(Evaluation of Toner)

—Method of Evaluation—

To the above toner particles are added, as external additives, 0.5% by weight of a hexamethyldisilazane-treated silica with an average particle size of 40 nm, and 0.7% by weight of a titanium compound (average particle size: 30 nm) obtained by treating metatitanic acid with 50% by weight of isobutyltrimethoxysilane and then baking the product, and the resulting mixture is then mixed for 10 minutes in a 75 liter Henschel mixer and then sieved using an air sieve apparatus Hivolter 300 (manufactured by Shin-Tokyo Kikai Co., Ltd.), thus yielding an external additive toner.

100 parts of a ferrite core with an average particle size of 50 μm is coated with 0.15 parts of vinylidene fluoride and 1.35 parts of a copolymer of methyl methacrylate and trifluoroethylene (polymerization ratio 80:20) using a kneader, thus forming a carrier. This carrier and the above toner are mixed together in a 2 liter V-blender in a mixing ratio of 100 parts:8 parts respectively, thus yielding a developer.

Using a modified DocuCentre Color 500 apparatus, manufactured by Fuji Xerox Co., Ltd. and shown in FIG. 1, the thus prepared developer is used for conducting image formation onto color paper (J-paper) manufactured by Fuji Xerox Co., Ltd, with a toner application quantity of 13.5 g/m$^2$. Following image formation, an external fixing unit is used to fix the image under a nip of 6.5 mm and a fixing speed of 180 mm/second. In order to evaluate the fixing and determine the minimum fixing temperature, the fixing unit is modified to enable the fixing temperature to be altered, and image fixing is then conducted while the fixing temperature of the fixing roller is increased in 5° C. increments from 90° C. An inward fold is inserted in the paper on which the image has been formed, at a position corresponding with substantially the center of the solid portion of the fixed toner image, the portion at which the fixed toner image has cracked is then wiped with a piece of tissue paper, and the width of the white line along the fold is measured. The temperature at which this white line width falls to no more than 0.5 mm is deemed the minimum fixing temperature (MFT). The MFT value for the toner of this example is 115° C.

(Evaluation of Blocking)

Using the prepared developer and the modified DocuCentre Color 500 apparatus, manufactured by Fuji Xerox Co., Ltd. and shown in FIG. 1, image formation is conducted under conditions of 28° C. and 85% RH, by printing a print test chart with an image density of 1% onto color paper (J-paper) manufactured by Fuji Xerox Co., Ltd. After 3,000 copies have been printed, the solid portion of the image is inspected for the occurrence of white banding. Furthermore, the toner inside the developing unit is removed and inspected visually for blocking. The evaluation criteria are shown below.

A: No white banding, and almost no blocking of toner inside developing unit

B: No white banding, but some minor blocking of toner evident inside developing unit C: Some minor white banding, and some blocking of toner evident inside developing unit D: White banding is very noticeable, and blocking of toner evident inside developing unit (Evaluation of Filming)

Using a DocuCentre Color 500 apparatus (manufactured by Fuji Xerox Co., Ltd.), a print test of 3,000 copies is conducted under conditions of 28° C. and 80% RH. Subsequently, the state of adhered material on the photoreceptor is evaluated visually. The evaluation criteria are shown below.

A: No adhered material visible on photoreceptor

B: Adhered material visible on photoreceptor, but very minimal

C: Adhered material that has grown in bands is visible on photoreceptor, but minimal D: Adhered material is noticeable across almost entire photoreceptor

Example 2

<Preparation of Toner (2)>

—Preparation of Electrophotographic Toner (2)—

With the exception of replacing the crystalline resin latex (1) with the crystalline resin latex (2), a toner is prepared in the same manner as the example 1. Measurement of the particle size of the electrophotographic toner (2) using a Coulter Counter reveals a volume average particle size of 6.7 μm. Furthermore, the volume GSD, which is an indicator of the volumetric particle size distribution, is 1.25.

This toner is evaluated in the same manner as that described for the example 1. The MFT is 115° C., the blocking evaluation is B, and the filming evaluation is B.

Example 3

<Preparation of Toner (3)>

—Preparation of Electrophotographic Toner (3)—

With the exception of replacing the crystalline resin latex (1) with the crystalline resin latex (3), a toner is prepared in the same manner as the example 1. Measurement of the particle size of the electrophotographic toner (3) using a Coulter Counter reveals a volume average particle size of 6.9 μm. Furthermore, the volume GSD, which is an indicator of the volumetric particle size distribution, is 1.24.

This toner is evaluated in the same manner as that described for the example 1. The MFT is 115° C., the blocking evaluation is B, and the filming evaluation is B.

Example 4

<Preparation of Toner (4)>

—Preparation of Electrophotographic Toner (4)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 330 parts by weight |
| Crystalline resin latex (1) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (1) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (4) using a Coulter Counter reveals a volume average particle size of 6.6 μm. Furthermore, the volume GSD, which is an indicator of the volumetric particle size distribution, is 1.25.

This toner is evaluated in the same manner as that described for the example 1. The MFT is 120° C., the blocking evaluation is A, and the filming evaluation is B.

Example 5

<Preparation of Toner (5)>

—Preparation of Electrophotographic Toner (5)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 330 parts by weight |
| Crystalline resin latex (1) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (3) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (5) using a Coulter Counter reveals a volume average particle size of 6.7 μm. Furthermore, the volume GSD, which is an indicator of the volumetric particle size distribution, is 1.26.

This toner is evaluated in the same manner as that described for the example 1. The MFT is 120° C., the blocking evaluation is A, and the filming evaluation is A.

Example 6

<Preparation of Toner (6)>

—Preparation of Electrophotographic Toner (6)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (2) | 330 parts by weight |
| Crystalline resin latex (1) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (2) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (6) using a Coulter Counter reveals a volume average particle size of 6.5 μm. Furthermore, the volume GSD, which is an indicator of the volumetric particle size distribution, is 1.23.

This toner is evaluated in the same manner as that described for the example 1. The MFT is 120° C., the blocking evaluation is B, and the filming evaluation is A.

Example 7

<Preparation of Toner (7)>

—Preparation of Electrophotographic Toner (7)—

With the exception of replacing the crystalline resin latex (1) with the crystalline resin latex (4), a toner is prepared in the same manner as the example 1. Measurement of the particle size of the electrophotographic toner (7) using a Coulter Counter reveals a volume average particle size of 6.7 μm. Furthermore, the volume GSD, which is an indicator of the volumetric particle size distribution, is 1.24.

This toner is evaluated in the same manner as that described for the example 1. The MFT is 125° C., the blocking evaluation is B, and the filming evaluation is B.

Example 8

<Preparation of Toner (8)>

—Preparation of Electrophotographic Toner (8)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 405 parts by weight |
| Crystalline resin latex (1) | 25 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (1) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (8) using a Coulter Counter reveals a volume average particle size of 6.4 μm. Furthermore, the volume GSD, which is an indicator of the volumetric particle size distribution, is 1.23.

This toner is evaluated in the same manner as that described for the example 1. The MFT is 135° C., the blocking evaluation is A, and the filming evaluation is B.

Example 9

<Preparation of Toner (9)>

—Preparation of Electrophotographic Toner (9)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 330 parts by weight |
| Crystalline resin latex (8) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (1) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (9) using a Coulter Counter reveals a volume average particle size of 6.6 μm. Furthermore, the volume GSD, which is an indicator of the volumetric particle size distribution, is 1.25.

This toner is evaluated in the same manner as that described for the example 1. The MFT is 120° C., the blocking evaluation is A, and the filming evaluation is B.

Example 10

<Preparation of Toner (10)>

—Preparation of Electrophotographic Toner (10)—

The components listed below are mixed together and dispersed in a round-bottom stainless steel flask using a homogenizer (ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (3) | 330 parts by weight |
| Crystalline resin latex (1) | 100 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. At this point, 70 parts by weight of the non-crystalline latex (2) that has been adjusted to pH=3 is added, and inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (10) using a Coulter Counter reveals a volume average particle size of 6.5 μm. Furthermore, the volume GSD, which is an indicator of the volumetric particle size distribution, is 1.23.

This toner is evaluated in the same manner as that described for the example 1. The MFT is 120° C., the blocking evaluation is B, and the filming evaluation is A.

Comparative Example 1

<Preparation of Toner (11)>

—Preparation of Electrophotographic Toner (11)—

With the exception of replacing the crystalline resin latex (1) with the crystalline resin latex (5), a toner is prepared in the same manner as the example 1. Measurement of the particle size of the electrophotographic toner (11) using a Coulter Counter reveals a volume average particle size of 6.3 μm. Furthermore, the volume GSD, which is an indicator of the volumetric particle size distribution, is 1.25.

This toner is evaluated in the same manner as that described for the example 1. The MFT is 135° C., the blocking evaluation is A, and the filming evaluation is B.

Comparative Example 2

<Preparation of Toner (12)>

—Preparation of Electrophotographic Toner (12)—

With the exception of replacing the crystalline resin latex (1) with the crystalline resin latex (6), a toner is prepared in the same manner as the example 4. Measurement of the particle size of the electrophotographic toner (12) using a Coulter Counter reveals a volume average particle size of 6.9 μm. Furthermore, the volume GSD, which is an indicator of the volumetric particle size distribution, is 1.25.

This toner is evaluated in the same manner as that described for the example 1. The MFT is 140° C., the blocking evaluation is A, and the filming evaluation is B.

Comparative Example 3

<Preparation of Toner (13)>

—Preparation of Electrophotographic Toner (13)—

With the exception of replacing the crystalline resin latex (1) with the crystalline resin latex (7), a toner is prepared in the same manner as the example 4. Measurement of the particle size of the electrophotographic toner (13) using a Coulter Counter reveals a volume average particle size of 6.7 μm. Furthermore, the volume GSD, which is an indicator of the volumetric particle size distribution, is 1.24.

This toner is evaluated in the same manner as that described for the example 1. The MFT is 95° C., the blocking evaluation is D, and the filming evaluation is D.

Comparative Example 4

<Preparation of Toner (14)>

—Preparation of Electrophotographic Toner (14)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Crystalline resin latex (1) | 500 parts by weight |
| Pigment dispersion | 20 parts by weight |
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. Inspection of the resulting contents under an optical microscope confirms that aggregate particles with a particle size of 6.5 μm have been formed. The pH is adjusted to a value of 8 using an aqueous solution of sodium hydroxide, the temperature is then raised to 75° C., and the aggregate particles are fused over a period of approximately 1 hour. The product is then cooled, filtered, washed thoroughly with ion-exchanged water and dried, thus yielding a toner.

Measurement of the particle size of the electrophotographic toner (14) using a Coulter Counter reveals a volume average particle size of 7.0 μm. Furthermore, the volume GSD, which is an indicator of the volumetric particle size distribution, is 1.24.

This toner is evaluated in the same manner as that described for the example 1. The MFT is 95° C., the blocking evaluation is D, and the filming evaluation is D.

Comparative Example 5

<Preparation of Toner (15)>

—Preparation of Electrophotographic Toner (15)—

The components listed below are mixed together and dispersed in a round-bottom stainless steel flask using a homogenizer (Ultra Turrax T50, manufactured by IKA Works Inc.), and the contents of the flask are then heated to 45° C. under constant stirring and then maintained at 45° C. for 30 minutes.

| | |
|---|---|
| Non-crystalline resin latex (1) | 500 parts by weight |
| Pigment dispersion | 20 parts by weight |

-continued

| | |
|---|---|
| Release agent dispersion | 70 parts by weight |
| 10% by weight aqueous solution of polyaluminum chloride (manufactured by Asada Chemical Co., Ltd.) | 1.5 parts by weight |

Subsequently, the temperature of the flask contents is raised gradually to 55° C. Inspection of the resulting contents under an optical microscope confirms that aggregate particles with a particle size of 6.5 μm have been formed. The pH is adjusted to a value of 8 using an aqueous solution of sodium hydroxide, the temperature is then raised to 90° C., and the aggregate particles are fused over a period of approximately 1 hour. The product is then cooled, filtered, washed thoroughly with ion-exchanged water and dried, thus yielding a toner.

Measurement of the particle size of the electrophotographic toner (15) using a Coulter Counter reveals a volume average particle size of 6.5 μm. Furthermore, the volume GSD, which is an indicator of the volumetric particle size distribution, is 1.24.

This toner is evaluated in the same manner as that described for the example 1. The MFT is 140° C., the blocking evaluation is B, and the filming evaluation is B.

TABLE 1

| | Example 1 Toner (1) | Example 2 Toner (2) | Example 3 Toner (3) | Example 4 Toner (4) | Example 5 Toner (5) | Example 6 Toner (6) |
|---|---|---|---|---|---|---|
| Crystalline resin A | Crystalline resin (1) | Crystalline resin (2) | Crystalline resin (3) | Crystalline resin (1) | Crystalline resin (1) | Crystalline resin (1) |
| Composition (molar ratio) | Behenyl acrylate: 70 Acrylic acid: 30 | Behenyl methaacrylate: 70 Methacrylic acid: 30 | Behenyl acrylate: 50 Acrylic acid: 50 | Behenyl acrylate: 70 Acrylic acid: 30 | Behenyl acrylate: 70 Acrylic acid: 30 | Behenyl acrylate: 70 Acrylic acid: 30 |
| Weight average molecular weight | 14,800 | 16,200 | 14,000 | 14,800 | 14,800 | 14,800 |
| Acid value | 61 | 63 | 101 | 61 | 61 | 61 |
| Melting point | 66 | 52 | 67 | 66 | 66 | 66 |
| Quantity of crystalline resin (% by weight) | 20 | 20 | 20 | 20 | 20 | 20 |
| Non-crystalline resin B | Non-crystalline resin (1) | Non-crystalline resin (1) | Non-crystalline resin (1) | Non-crystalline resin (1) | Non-crystalline resin (1) | Non-crystalline resin (2) |
| Quantity of non-crystalline resin (% by weight) | 80 | 80 | 80 | 66 | 66 | 66 |
| Coating Layer Resin C | None | None | None | Non-crystalline resin (1) | Non-crystalline resin (3) | Non-crystalline resin (2) |
| Quantity of coating layer resin (% by weight) | 0 | 0 | 0 | 14 | 14 | 14 |
| MFT (° C.) | 115 | 115 | 115 | 120 | 120 | 120 |
| Blocking evaluation | B | B | B | A | A | B |
| Filming evaluation | B | B | B | B | A | A |

TABLE 2

| | Example 7 Toner (7) | Example 8 Toner (8) | Example 9 Toner (9) | Example 10 Toner (10) |
|---|---|---|---|---|
| Crystalline resin A | Crystalline resin (4) | Crystalline resin (1) | Crystalline resin (8) | Crystalline resin (1) |
| Composition (molar ratio) | Behenyl acrylate: 70 Acrylic acid: 30 | Behenyl acrylate: 70 Acrylic acid: 30 | Behenyl acrylate: 85 Acrylic acid: 15 | Behenyl acrylate: 70 Acrylic acid: 30 |
| Weight average molecular weight | 5,900 | 14,800 | 16,600 | 14,800 |
| Acid value | 58 | 61 | 30 | 61 |
| Melting point | 63 | 66 | 65 | 66 |
| Quantity of crystalline resin (% by weight) | 20 | 5 | 20 | 20 |
| Non-crystalline resin B | Non-crystalline resin (1) | Non-crystalline resin (1) | Non-crystalline resin (1) | Non-crystalline resin (3) |

TABLE 2-continued

| | Example 7 Toner (7) | Example 8 Toner (8) | Example 9 Toner (9) | Example 10 Toner (10) |
|---|---|---|---|---|
| Quantity of non-crystalline resin (% by weight) | 80 | 81 | 66 | 66 |
| Coating Layer Resin C | None | Non-crystalline resin (1) | Non-crystalline resin (1) | Non-crystalline resin (2) |
| Quantity of coating layer resin (% by weight) | 0 | 14 | 14 | 14 |
| MFT (° C.) | 125 | 135 | 120 | 120 |
| Blocking evaluation | B | A | A | B |
| Filming evaluation | B | B | B | A |

TABLE 3

| | Example | | | | |
|---|---|---|---|---|---|
| | Comparative example 1 Toner (11) | Comparative example 2 Toner (12) | Comparative example 3 Toner (13) | Comparative example 4 Toner (14) | Comparative example 5 Toner (15) |
| Crystalline resin A | Crystalline resin (5) | Crystalline resin (6) | Crystalline resin (7) | Crystalline resin (1) | None |
| Composition (molar ratio) | Behenyl acrylate: 90 Acrylic acid: 5 | Behenyl acrylate: 70 Methyl acrylate: 30 | Sebacic acid Ethylene glycol | Behenyl acrylate: 70 Acrylic acid: 30 | — |
| Weight average molecular weight | 16,000 | 12,000 | 20,300 | 14,800 | — |
| Acid value | 9 | 58 | 8,700 | 61 | — |
| Melting point | 66 | 63 | 1 | 66 | — |
| Quantity of crystalline resin (% by weight) | 20 | 20 | 20 | 100 | 0 |
| Non-crystalline resin B | Non-crystalline resin (1) | Non-crystalline resin (1) | Non-crystalline resin (1) | None | Non-crystalline resin (1) |
| Quantity of non-crystalline resin (% by weight) | 66 | 66 | 66 | 0 | 100 |
| Coating Layer Resin C | Non-crystalline resin (1) | Non-crystalline resin (1) | Non-crystalline resin (1) | None | None |
| Quantity of coating layer resin (% by weight) | 14 | 14 | 14 | 0 | 0 |
| MFT (° C.) | 135 | 140 | 95 | 95 | 140 |
| Blocking evaluation | A | A | D | D | B |
| Filming evaluation | B | B | D | D | B |

The results of the examples are summarized in Table 1. The toners of the present invention offer superior low-temperature fixability to the toner of the comparative example 5. Furthermore, compared with the toners of the comparative examples 3 and 4, which represent the conventional technology, the toners of the present invention exhibit excellent resistance to blocking and filming. Furthermore, a comparison of the comparative example 1 and the toners of the present invention reveals that by setting the quantity of the alkyl acrylate and the copolymerization quantity of the carboxylic acid component to suitable values, a toner with a lower MFT value can be obtained.

An electrophotographic toner of the present invention is particularly useful for applications that employ electrophotographic methods and electrostatic recording methods.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic toner, comprising a colorant, a release agent, a non-crystalline resin and a crystalline resin, wherein the crystalline resin is a polyalkyl acrylate or polyalkyl methacrylate having an alkyl group of approximately 18 or more carbon atoms, and is produced by copolymerization with approximately 10 mol % or more, but no more than approximately 50 mol %, of a vinyl monomer having a carboxyl group.

2. The electrophotographic toner according to claim 1, wherein the non-crystalline resin is a resin comprising a styrene-based resin.

3. The electrophotographic toner according to claim 1, wherein a weight average molecular weight (Mw) of a tetrahydrofuran (THF) soluble fraction of the non-crystalline resin, measured using gel permeation chromatography (GPC), is within a range from approximately 5,000 to 50,000.

4. The electrophotographic toner according to claim 1, wherein an acid value of the crystalline resin is within a range from approximately 20 to 120 mgKOH/g.

5. The electrophotographic toner according to claim 1, wherein a weight average molecular weight of the crystalline resin, measured by a molecular weight measurement method, is within a range from approximately 3,000 to 70,000.

6. The electrophotographic toner according to claim 1, wherein the non-crystalline resin is a polyester-based resin.

7. The electrophotographic toner according to claim 1, wherein the toner is prepared using an aggregation method.

8. The electrophotographic toner according to claim 1, wherein the toner comprises a coating layer, and a thickness of the coating layer is approximately 0.05 μm or greater but no more than approximately 0.5 μm.

9. The electrophotographic toner according to claim 1, wherein the toner comprises a coating layer.

10. The electrophotographic toner according to claim 9, wherein the coating layer comprises a non-crystalline polyester, and comprises alkyl groups of 6 or more carbon atoms as side chains.

11. The electrophotographic toner according to claim 1, wherein a ratio between the non-crystalline resin and the crystalline resin is within a range from approximately 60/40 to approximately 95/5.

12. The electrophotographic toner according to claim 1, wherein a quantity added of the release agent is within a range from approximately 0.5 to 50% by weight relative to a total weight of the toner.

13. An electrophotographic developer, comprising:

an electrophotographic toner, comprising a colorant, a release agent, a non-crystalline resin and a crystalline resin, wherein the crystalline resin is a polyalkyl acrylate or polyalkyl methacrylate having an alkyl group of approximately 18 or more carbon atoms, and is produced by copolymerization with approximately 10 mol % or more, but no more than approximately 50 mol %, of a vinyl monomer having a carboxyl group; and a carrier.

14. The electrophotographic developer according to claim 13, wherein a volume average particle size of core particles of the carrier is within a range from approximately 30 to 200 μm.

15. The electrophotographic developer according to claim 13, wherein the non-crystalline resin within the electrophotographic toner is a resin comprising a styrene-based resin.

16. The electrophotographic developer according to claim 13, wherein a weight average molecular weight (Mw) of a tetrahydrofuran (THF) soluble fraction of the non-crystalline resin within the electrophotographic toner, measured using gel permeation chromatography (GPC), is within a range from approximately 5,000 to 50,000.

17. The electrophotographic developer according to claim 13, wherein an acid value of the crystalline resin within the electrophotographic toner is within a range from approximately 20 to 120 mgKOH/g.

18. An electrophotographic developer that uses the electrophotographic developer according to claim 13.

* * * * *